US005509045A

United States Patent [19]

Kautz

[11] Patent Number: 5,509,045

[45] Date of Patent: Apr. 16, 1996

[54] X-RAY TUBE HAVING A GETTER SHEILD AND METHOD

[75] Inventor: Allan D. Kautz, Naperville, Ill.

[73] Assignee: Picker International, Inc., Highland Hts., Ohio

[21] Appl. No.: 386,011

[22] Filed: Feb. 9, 1995

[51] Int. Cl.[6] ..... H01J 35/04

[52] U.S. Cl. ..... 378/123; 378/121

[58] Field of Search ..... 378/121, 123, 378/119, 136

[56] References Cited

U.S. PATENT DOCUMENTS 2,502,070 3/1950 Atlee et al. .

3,081,413 3/1963 Cummings ..... 378/123

5,438,605 8/1995 Burke et al. ..... 378/135

*Primary Examiner*—David P. Porta

*Assistant Examiner*—Don Wong

*Attorney, Agent, or Firm*—Fay, Sharpe, Beall, Fagan, Minnich & McKee

[57] ABSTRACT

An x-ray tube (14) has an evacuated envelope (30) in which an anode (32), a cathode (34), and a getter shield (60) are disposed. The shield includes a sleeve (62) and a cap (64). The cap defines an annular groove (70). A getter material (72) is deposited in the groove and sintered to define a porous volume. The getter material is activated during normal exhaustion of the x-ray tube during manufacture. During operation of the tube to generate x-rays, the waste heat is absorbed by the cap passively raising the getter material to its pumping temperature.

16 Claims, 4 Drawing Sheets

X-RAY TUBE HAVING A GETTER SHEILD AND METHOD

BACKGROUND OF THE INVENTION

The present invention pertains to the vacuum tube art, particularly getter materials for maintaining vacuums. It finds particular application in conjunction with rotating anode x-ray tubes for CT scanners and will be described with particular reference thereto. However, it is to be appreciated that the present invention will also find application in conjunction with other vacuum tubes for the generation of radiation and vacuum tubes for other applications.

Typically, rotating anode x-ray tubes include a sealed and evacuated envelope in which the cathode, anode, anode bearings, anode rotor, and other associated structures are sealed. Because the envelope is evacuated, getter material is usually provided inside the envelope to maintain the vacuum state. The getter material binds gases on its surface and/or absorbs such gases to maintain the vacuum state in the tube after it has been exhausted. This process of removing residual gases from an evacuated area by binding and/or absorbing is known as pumping.

A getter shield is also provided to the x-ray tube at an end of the tube opposite the anode to protect the getter and encase selected electronics of the tube. Getter shields are typically constructed of 1215 steel.

With respect to the getter material itself, some prior systems have utilized a barium wire getter mounted within the getter shield. Other prior systems have used a porous getter in contact with a resistance heater enclosed in a ceramic package. The porous getter was mounted within the getter shield and heated by passing electric current through the resistance heater. Still other prior systems utilized a porous getter attached to wire mounted legs with a ceramic material in a cartridge. The cartridge was mounted within the getter shield. Heat was provided to the getter by thermoradiation from the target striking the getter by passing through holes drilled through the getter shield.

These prior systems have had difficulties. First, insufficient getter material is provided to maintain desired pumping speed and gas capacity. Second, prior getter materials have undesirably long activation times requiring high temperatures and low pressure. Last, the prior systems achieve relatively low temperature levels which compromise operation.

The present invention contemplates a new and improved x-ray tube using a getter shield and method which resolves the above-referenced difficulties and others.

SUMMARY OF THE INVENTION

An x-ray tube has an evacuated envelope and an anode and a cathode disposed in the envelope. A shield is mounted in the envelope to protect electrical connections and components associated with the cathode.

In accordance with one aspect of the invention, the shield includes a sleeve with a cap received in the sleeve which is mounted in the envelope. The cap has a groove on a surface thereof with getter material disposed therein. In this manner, the getter is integrally incorporated into the shield.

In accordance with another aspect of the invention, a method of forming the getter shield includes forming the groove in the end cap, sintering the getter material into the groove, and mating the end cap with the sleeve.

In accordance with another aspect of the invention, the x-ray tube is exhausted to evacuate contaminant gases therefrom by baking the tube at a predetermined first temperature under a preselected first pressure for a predetermined period of time. The getter material is concurrently activated by exposing the getter material to the predetermined first temperature and pressure for the predetermined period of time along with the rest of the tube. Heat is generated in the tube to obtain a predetermined second temperature by operating the tube. The getter material is pumped to absorb residual contaminant gases by exposing the getter material to the predetermined second temperature.

One advantage of the present invention is that the getter and shield are an integral system. No extra parts or mountings are required and the basic configuration of the conventional x-ray tube is not changed or affected.

Another advantage of the present invention is that the getter shield is self heated during operation and thus no external heating via electrical feedthroughs are required.

Another advantage of the present invention is that the getter can be activated simultaneously as the tube is exhausted using the standard heating processes. No additional operations or equipment are required.

Another advantage of the present invention is that normal operating temperatures within the tube are sufficient to provide satisfactory pumping characteristics for the getter material.

Another advantage of the present invention is that the getter is able to withstand heat treatment in air.

Another advantage of the present invention is that an excessive number of particles are not generated from embrittlement of the getter and/or poor adhesion between the getter material and the substrate. High chemical and mechanical stability of the getter material resists embrittlement and offers a solid bond between the getter material and the shield mounting.

Another advantage of the present invention is that it has a high absorption capacity.

Another advantage of the present invention is that the getter shield allows for a substantial volume of getter material to be provided to the x-ray tube.

Still further advantages of the present invention will become apparent to those of ordinary skill in the art upon reading and understanding the following detailed description of the preferred embodiment.

BRIEF DESCRIPTION OF THE DRAWINGS

The invention may take form in various components and arrangements of components and in various steps and arrangement of steps. The drawings are only for purposes of illustrating the preferred embodiments and are not to be construed as limiting the invention.

DETAILED DESCRIPTION OF THE PREFERRED EMBODIMENTS

Figure 1:
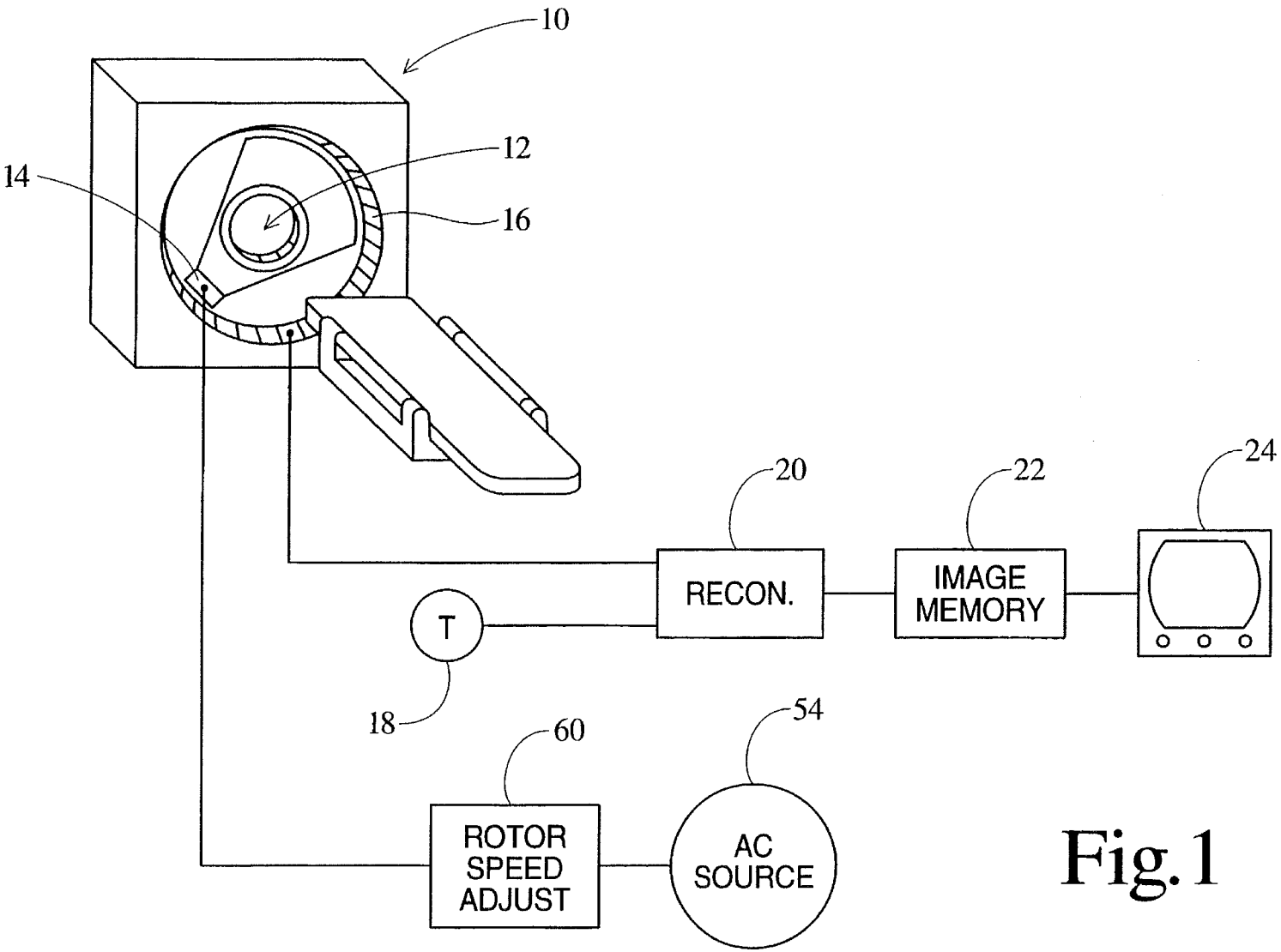
FIG. 1 is a diagrammatic of an x-ray diagnostic system in accordance with the present invention.

With reference to FIG. 1, a medical diagnostic apparatus 10 examines a subject in an examination region 12 with x-rays. More specifically, an x-ray tube 14 projects radiation through the examination region 12 and onto an x-ray detector assembly 16. Although the x-ray detector assembly in the illustrated CT scanner embodiment is a ring which converts x-rays into electrical signals, other x-ray detection means are contemplated. For example, the medical diagnostic apparatus can be one which produces projection or shadowgraphic images on x-ray sensitive photographic film. As another alternative, the x-ray diagnostic apparatus can be a digital x-ray system which generates shadowgraphic x-ray images in single or multiple energies electronically. Still other x-ray diagnostic apparatus are contemplated.

The x-ray detector assembly 16 and a tachometer or angular position encoder 18 for detecting rotation or angular position of the x-ray source 14 are connected with an image reconstruction processor The image reconstruction processor utilizes conventional convolution and backprojection or other reconstruction algorithms as are known in the art. The reconstruction means produces an electronic image representation for storage in an image memory 22. A human readable display means 24, such as a video monitor, produces a diagnostic display of the reconstructed image. Preferably, a video processor formats the reconstructed image data into a selected format such as a slice, projection, surface rendering, sculptured volumes, and the like.

Figure 2:
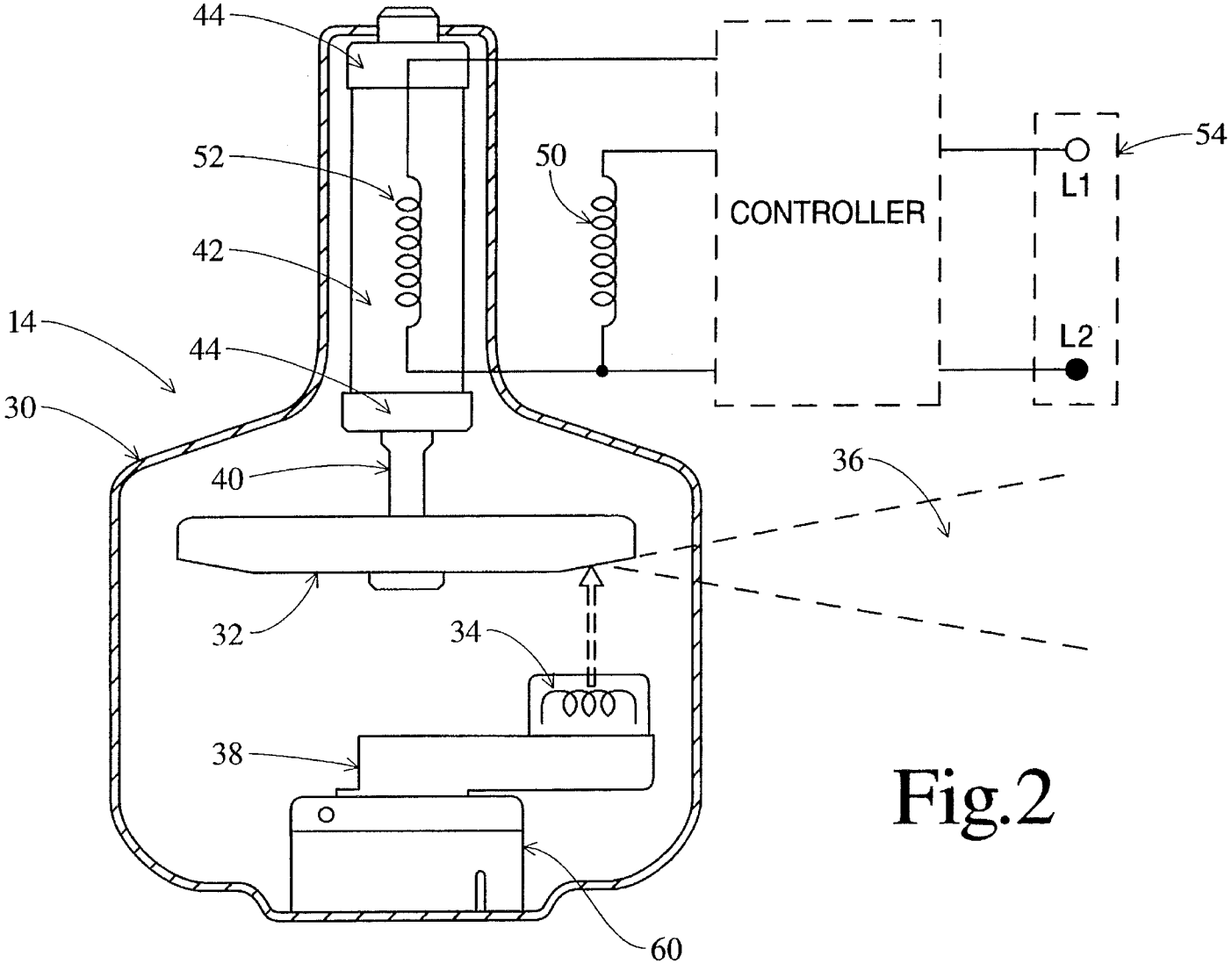
FIG. 2 illustrates a cross-sectional view of a rotating anode x-ray tube of FIG. 1.

With continued reference to FIG. 1 and further reference to FIG. 2, the x-ray tube 14 includes an evacuated envelope 30 in which an anode 32 is rotatably mounted. A beam of electrons selectively flows from a heated element cathode 34 to a focal spot on the rotating anode from which a beam 36 of x-rays emanates. Cathode 34 is supported in the envelope 30 on cathode support assembly 38. The anode is connected to a shaft 40 which is connected to an induction motor 42. The motor 42 including rotor windings and associated bearings are mounted in a neck portion of the evacuated envelope 30.

The rotor windings are electromagnetically coupled with a main stator winding 50 and an auxiliary stator winding 52 on the outside of the evacuated envelope neck portion. The stator windings are interconnected with a source 54 of AC line current. With this arrangement, the rotor rotates at generally the oscillation frequency of the line current source. Bearing friction, inefficiencies in the electromagnetic transfer through the envelope 30, and the like generally cause the rotor speed to lag the AC line current frequency by a small amount, e.g. 2% or 3%.

A shield 60 is disposed at an end of the x-ray tube opposite the anode 32 and motor 42. The shield 60 surrounds the support assembly 38 for the cathode 34 and electronics and electrical feedthroughs (not shown) used to operate the cathode 34 and provide a high voltage across the cathode and anode.

Figure 3:
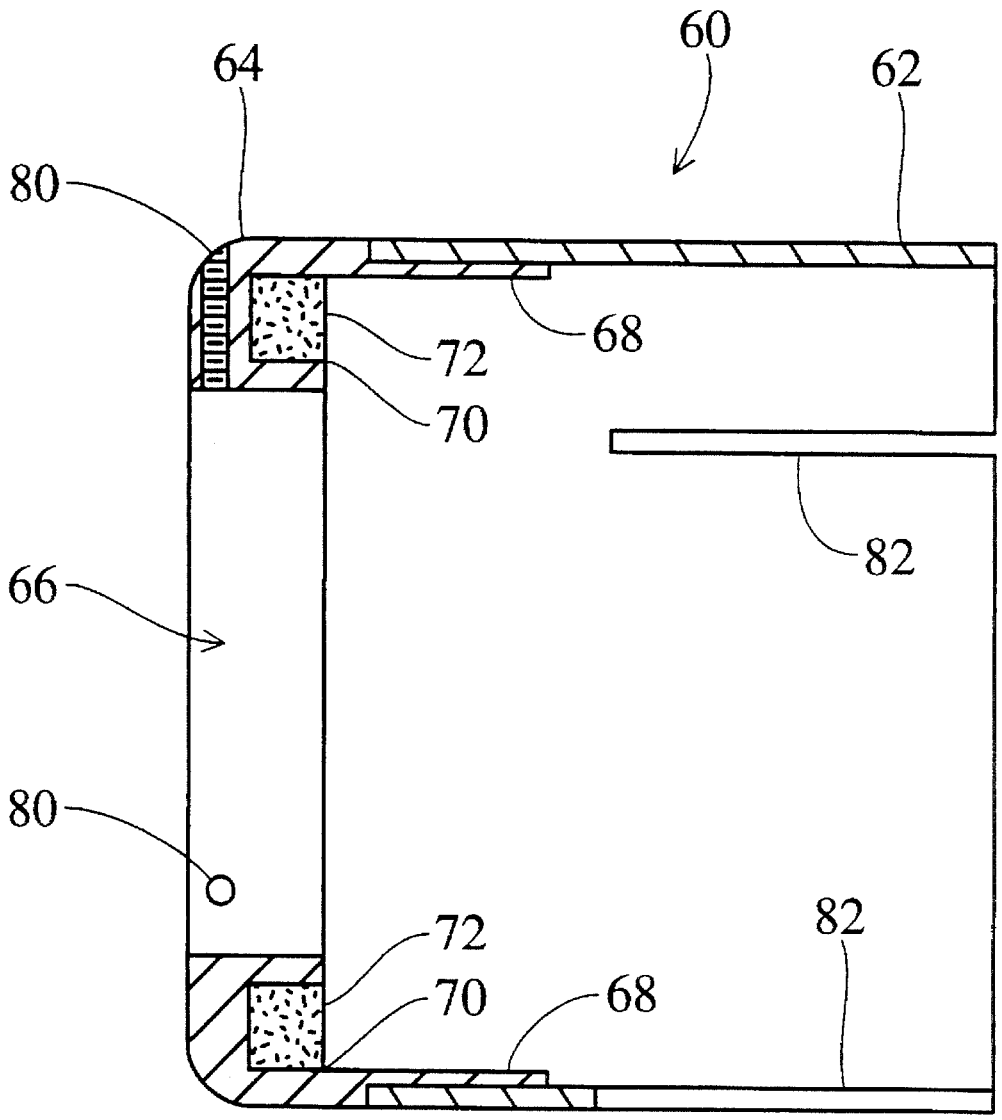
FIG. 3 is a cross-sectional view of the getter shield according to the present invention; and, FIG. 4 is an end view of the end cap of the getter shield of FIG. 3.

Referring now to FIG. 3, the shield 60 includes a generally cylindrical sleeve 62 and an end cap 64. The end cap 64 is an annular ring defining an aperture 66 to accommodate the cathode 34, i.e., receive the cathode support assembly 38. The end cap 64 further includes a lip 68 adapted to be received telescopically in the sleeve 62.

The end cap 64 defines a groove 70 circumscribing the aperture 66 along an inner surface of the cap. The groove 70 has getter material 72 deposited therein. In the preferred embodiment, the groove has at least 4 cc of volume and receives at least 13 gms of getter material.

Alternatively, the getter material 72 is deposited on other surfaces within the tube 14. The following criteria, which are met by utilizing the groove, are also preferably met if an alternative surface other than the groove is utilized:

1. The surface offers good adhesion qualities.
2. The surface temperature during exhaust allows for substantially full activation of the getter material.
3. The surface temperature during normal operation provides good pumping characteristics for the getter material.
4. The mounting preferably allows for sufficient volume of getter material to provide adequate gas pumping capacity.
5. Proper operation of the tube is not compromised.

Figure 4:
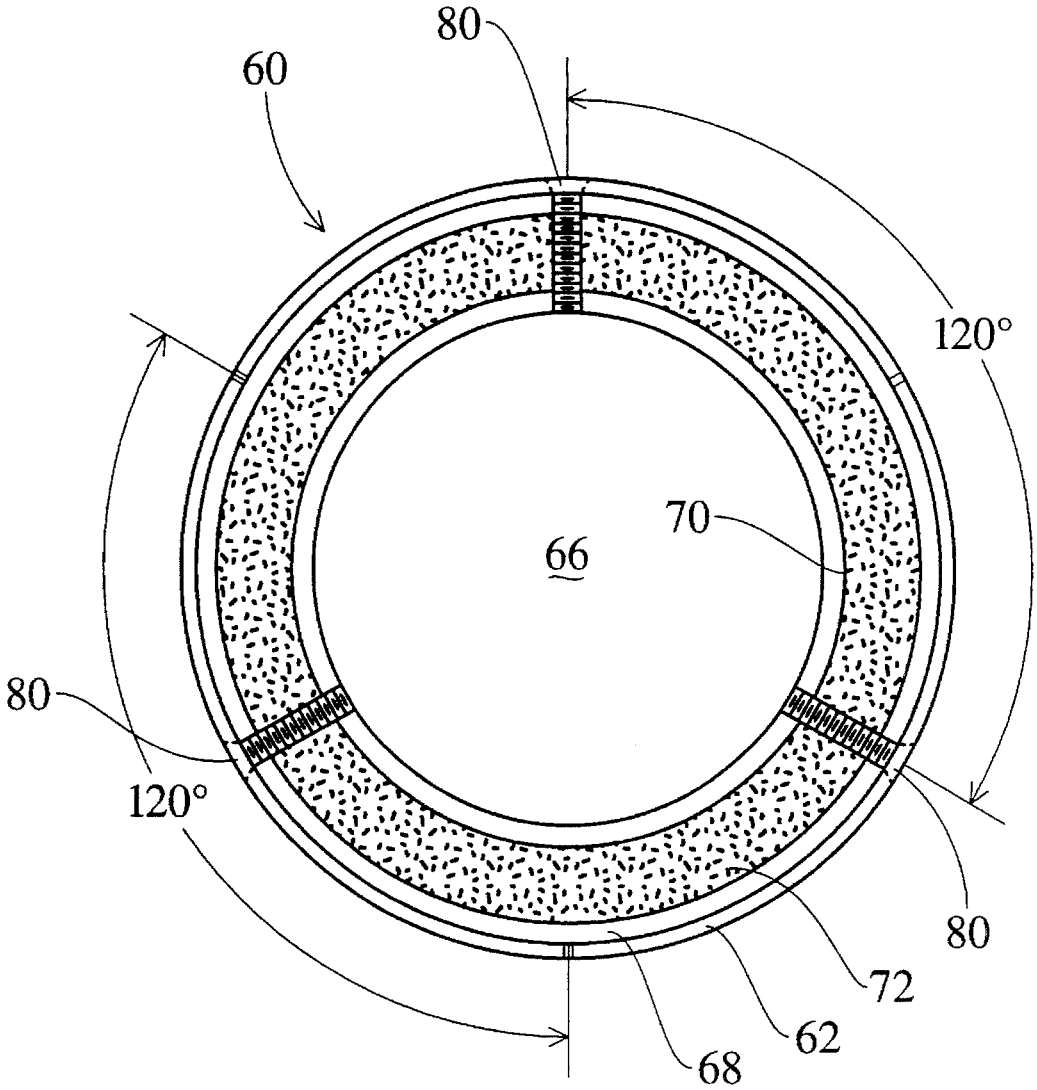

With reference to FIG. 4 and continuing reference to FIG. 3, the shield 60 is provided with threaded bores 80 radially disposed in end cap 64. Preferably, three apertures 80 are bored approximately 120° apart around the circumference of the cap 64. The apertures 80 receive screws, bolts, rivets, or other suitable connectors (shown in phantom in FIG. 4), to secure the cap 64 and the cathode support assembly 38. In this manner, the getter shield 60 is secured within the tube 14.

Additionally, the end cap 64 includes longitudinal slots 82 formed in the sleeve 62. The slots 82 extend inwardly from an end of the sleeve opposite the end cap 64. The slots 82 prevent rf coupling to the getter shield during induction heating so that the shield does not overheat and cause the getter, mounted within the shield, to evaporate. Like the bores 80, the slots 82 are disposed at intervals of 120° around the circumference of the shield 60. Relative to the bores 80, though, the slots 82 are preferably offset by 60°.

Preferably, both the end cap 64 and the sleeve 62 are constructed of nickel steel of 42%–100% nickel. This material provides maximum adhesion with the getter material and has a thermal expansion coefficient similar to the getter material 72. Similar thermal expansion coefficients help prevent cracking and destruction of the material during changes in the thermal environment.

The getter material 72 is a barium-free matrix of titanium tantalum and/or thorium, and tungsten and/or zirconium. A commercially available SAES st175 getter material is satisfactory. However, other getter materials which meet the characteristics described herein are suitable.

The shield 60 is constructed by first machining the groove 70 in the end cap 64. The getter material 72 is loaded into the groove 70 of the cap 64 and sintered. The cap 64 and the sleeve 62 are then mated by inserting lip 68 telescopically into sleeve 62 to form the complete getter shield 60. The cap 64 is retained in the sleeve 62 by friction fit, optionally aided by a suitable bonding material.

As those skilled in the art will appreciate, the cathode and/or cathode assembly is physically sealed to the envelope 30, which is glass and contains the anode assembly. The shield 60 is typically heated by this sealing process to a temperature maximum of 300° C. Accordingly, a requirement of the preferred getter material is the ability to withstand heat treatment in air up to this temperature. The preferred commercially available SAES st175 getter material is able to withstand heat treatment in air up to 400° C.

With respect to the evacuation of the x-ray tube 14 during manufacture, the tube 14 is baked and exhausted at an approximate temperature of 500° C. for approximately 55 minutes at $10^{-5}$ Torr to activate the getter material and remove surface layer of contamination on the getter material as a precursor to a conventional soak process during manufacture.

As the tube is operated after installation in a diagnostic scanner, residual gases are removed from the vacuum state of the tube 14 by the getter material 72. This process is called pumping. The temperature of the tube is typically above 400° C. at which temperature preferred getter material 72 has excellent pumping characteristics and does not vaporize or breakdown. The preferred getter also has good pumping characteristics at 150°–300° C. allowing it to be affixed to cooler surfaces in the envelope. Alternately, the getter can be heated to 500° C. for approximately 1 hour to an hour and a half at 10–7 Torr in the x-ray tube soak process. Shorter durations only partially activate the getter. For example, 15 minutes at 500° C. activates the preferred getter to 50% capacity.

The present invention provides significant advantages over prior systems in that once the getter material 72 is deposited in the groove 70, no further attachment mechanisms are required to secure the getter material within the tube 14. Moreover, the getter material 72 is activated simultaneously with the standard heating processes as a result of the low activation temperature of the preferred getter material 72. No additional operations or equipment (heating resistors and/or electrical feedthroughs) are thus needed. Likewise, normal operating temperatures within the tube 14 are sufficient to provide significant pumping characteristics for the getter material 72. Accordingly, a simple configuration is realized which allows for normal operation of the x-ray tube 14.

High chemical and mechanical stability of the preferred getter material 72 result in low embrittlement and a solid bond between the getter material 72 and the nickel steel comprising the end cap 64 and the sleeve 62. Accordingly, excessive, loose getter material particles are not generated in the tube 14 as a result of embrittlement of the getter material 72 and/or poor adhesion of the getter material 72 to the groove 70 of end cap 64.

The large volume of getter material held in the groove allows for high absorption capacity. Additionally, the preferred design of the getter shield 60 allows for a substantial volume of getter material 72 to be provided to the tube 14, thus increasing efficiency.

The invention has been described with reference to the preferred embodiments. Obviously, modifications and alterations will occur to others upon reading and understanding the preceding detailed description. It is intended that the invention be construed as including all such modifications and alternations insofar as they come within the scope of the appended claims or their equivalence thereof.

Having thus described the preferred embodiment, the invention is now claimed to be:

1. In an x-ray tube including an evacuated envelope, an anode mounted within the evacuated envelope and connected with a rotor to provide rotation thereof, and a cathode for generating a beam of electrons which impinge upon the rotating anode on a focal spot to generate a beam of x-rays and a shield for shielding electrical components associated with the cathode that are mounted in the evacuated envelope, the improvement comprising:

the shield having a sleeve disposed in the envelope;

a cap defining a groove therein mounted on the shield; and, a getter material mounted in the groove.

2. A getter shield for shielding electrical components associated with a cathode of an x-ray tube having an evacuated envelope and an anode and the cathode disposed in the envelope, the shield comprising:

a sleeve disposed in the envelope;

a cap received on the sleeve, the cap having a groove disposed on a surface thereof; and, getter material disposed in the groove.

3. The getter shield as set forth in claim 2 wherein the sleeve is generally cylindrical.

4. The getter shield as set forth in claim 2 wherein the sleeve is constructed of nickel steel and the getter material has a common coefficient of thermal expansion with nickel steel and is sintered in the groove.

5. The getter shield as set forth in claim 2 wherein the cap comprises a generally annular ring having a lip disposed about a circumference thereof.

6. The getter shield as set forth in claim 2 wherein the groove is generally circular and disposed about a periphery of the cap.

7. The getter shield as set forth in claim 2 wherein the cap and the getter material have a common coefficient of thermal expansion.

8. The getter shield as set forth in claim 7 wherein the cap is constructed of nickel steel and the getter material has a common coefficient of thermal expansion with nickel steel and is sintered in the groove.

9. The getter shield as set forth in claim 2 wherein the sleeve includes a first end to receive the cap and close proximity to the anode and cathode, and a second end spaced from the anode and cathode.

10. The getter shield as set forth in claim 2 wherein the getter material includes material having sufficient chemical and mechanical stability to prevent embrittlement of the getter material and facilitate adhesion between the getter material and the end cap.

11. The getter shield as set forth in claim 2 wherein the getter material includes non-evaporable and porous material.

12. The getter shield as set forth in claim 2 wherein the getter material includes material having an activation temperature of 500° C.

13. The getter shield as set forth in claim 2 wherein the getter material is a porous, sintered material and the groove is an annular groove which receives more than 4 cc the porous sintered getter material.

14. A method for evacuating an x-ray tube including an envelope and an anode, a cathode, and a getter shield for surrounding electrical components associated with the cathode in the envelope, the getter shield including a sleeve, a cap having a groove therein received in the sleeve, and getter material mounted in the groove, the method comprising:

exhausting the tube to evacuate gases therefrom by exposing the tube to a predetermined first temperature and a predetermined pressure for a predetermined period of time;

simultaneously activating the getter material by exposing the getter material to the predetermined first temperature and the predetermined pressure for the predetermined period of time;

operating the tube to generate heat to raise the getter material to a second temperature such that the getter material absorbs residual contaminant gases.

15. The method as set forth in claim 14 wherein the first temperature is approximately 500°, the predetermined period of time is at least 55 minutes, the predetermined pressure is at least $10^{-5}$ Torr, and the second temperature is at least 400° C.

16. The method as set forth in claim 14 wherein the getter material is heated to the second temperature passively, solely by absorbing heat generated during x-ray generation.

* * * * *